US005193460A

United States Patent [19]

Kleitz et al.

[11] Patent Number: 5,193,460

[45] Date of Patent: Mar. 16, 1993

[54] PUMP CONFIGURATION FOR AN INK SUPPLY TANK OF AN INKING SYSTEM IN FRANKING AND VALUE STAMPING MACHINES

[75] Inventors: Lothar Kleitz, Friedberg; Ernst Prohaska, Dietzbach, both of Fed. Rep. of Germany

[73] Assignee: Francoytp-Postalia GmbH, Berlin, Fed. Rep. of Germany

[21] Appl. No.: 877,857

[22] Filed: May 4, 1992

[30] Foreign Application Priority Data

May 4, 1991 [DE] Fed. Rep. of Germany ..... 4114963

[51] Int. Cl.[5] ..... B41F 31/08

[52] U.S. Cl. ..... 101/366

[58] Field of Search ..... 101/366, 350, 363, 207, 101/208-210, 364; 415/72, 73, 220; 416/176, 177; 418/180, 182

[56] References Cited

U.S. PATENT DOCUMENTS 2,573,336 10/1951 Holmwood ..... 101/364

3,540,412 11/1970 Lloyd ..... 101/364 X

*Primary Examiner*—J. Reed Fisher

*Attorney, Agent, or Firm*—Herbert L. Lerner; Laurence A. Greenberg

[57] ABSTRACT

A franking and value stamping machine includes an inking system with a housing, inking rollers, and inlet and return necks. A pump assembly includes tube or hose connections communicating with the inlet and return necks. An ink supply tank that communicates with the tube or hose connections has two ink containers. A guide tube provides communication between the ink containers. A threaded spindle is supported in the guide tube and driven by an electric motor through a coupling as a pumping unit.

9 Claims, 1 Drawing Sheet

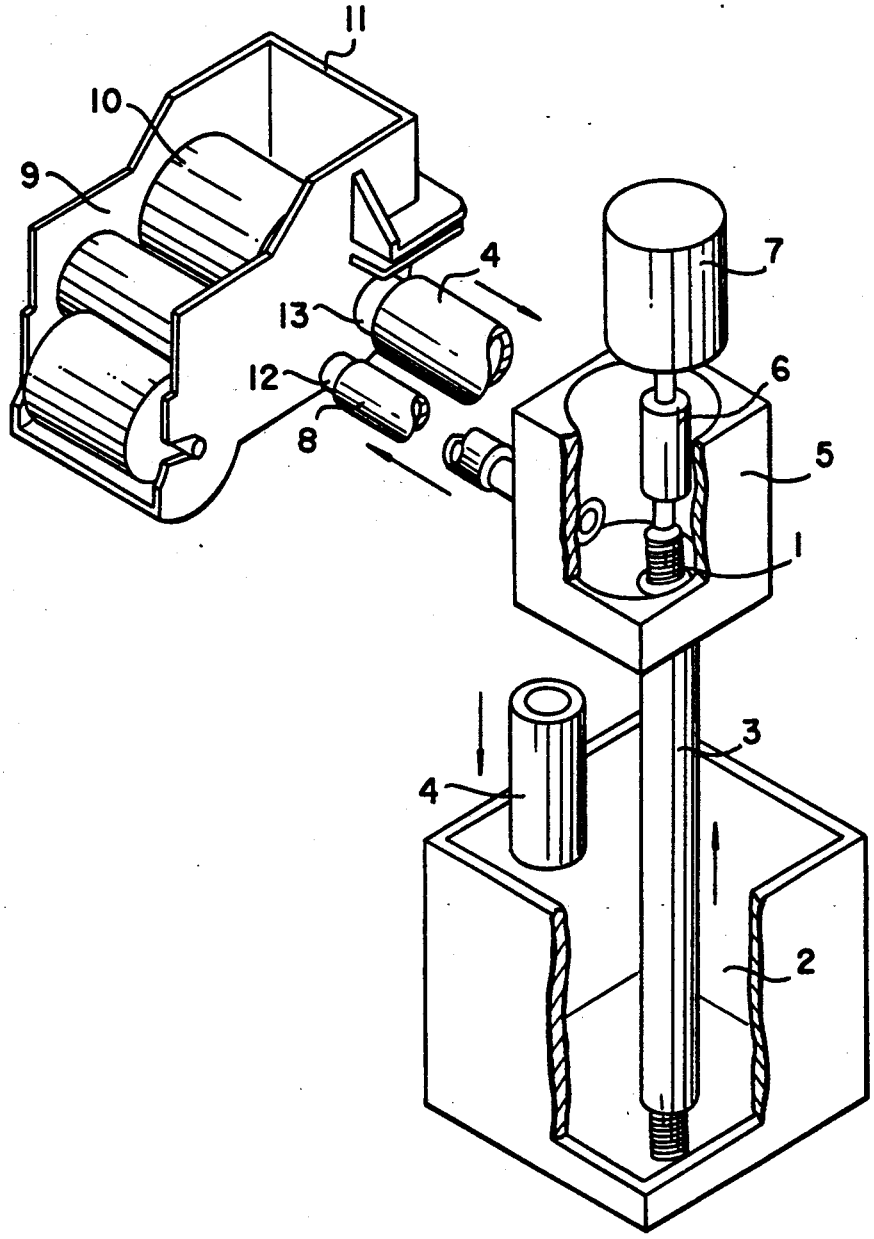
11
10
9
4
13
12
8
7
6
5
1
3
4
2

PUMP CONFIGURATION FOR AN INK SUPPLY TANK OF AN INKING SYSTEM IN FRANKING AND VALUE STAMPING MACHINES

The invention relates to a pump configuration for an ink supply tank of an inking system in franking and value stamping machines which includes a housing with inking rollers that is connected to an ink supply tank through inlet and return necks.

Pump-driven inking systems are known from German Patent DE 33 16 558 C2. In those systems the stamping ink is delivered continuously from a supply container through flexible hoses, with the interposition of a pump system. Hose pumps and diaphragm pumps are used as the pump system. In hose pumps, imprecise guidance of the hoses can cause a functional failure, and if the machine is idle for relatively long periods and the ink dries, bursting of the hose when the machine is put back into operation can cause grave damage from soiling of many machine parts.

The use of diaphragm pumps requires complicated and expensive synchronization of the feed and return pumps. Moreover, soiling or thickening of the ink can cause failure of the ink delivery. The danger of soiling also exists when valves are used, as proposed by Published European Application No. 0 376 477 A2. Other inking systems, which work without a pump system, for instance by transferring the ink from a supply container by means of a porous wiper that dips into the ink, in accordance with German Patent DE 38 16 548 C2, have too small a capacity for high-speed machines, which allow up to 10,000 franking operations per hour.

It is accordingly an object of the invention to provide a pump configuration for an ink supply tank of an inking system in franking and value stamping machines, which overcomes the hereinafore-mentioned disadvantages of the heretofore-known devices of this general type, which operates functionally reliably, even if the ink should thicken or soil the machinery, and which can be used for high-speed franking machines.

With the foregoing and other objects in view there is provided, in accordance with the invention, in a franking and value stamping machine having an inking system with a housing, inking rollers, and inlet and return necks, a pump assembly comprising tube or hose connections communicating with the inlet and return necks, an ink supply tank communicating with the tube or hose connections and having two ink containers, a guide tube through which the ink containers communicate with each other, an electric motor, a coupling connected to the electric motor, and a threaded spindle being supported in the guide tube and driven by the electric motor through the coupling as a pumping unit.

Due to the electrically driven threaded spindle, thickening is overcome in the briefest possible time. Moreover, with this type of pumping, relatively high circulation of the ink supply is attained, which is necessary for high-speed franking machines.

Another advantage is that the threaded spindle can be operated as either a negative pressure or an overpressure pump. As a result, variable adaptations to the consistency of the ink and to structural conditions become possible.

In accordance with another feature of the invention, the ink containers are first and second ink containers, and the threaded spindle aspirates ink from the first ink container into the second ink container and delivers the ink to the inking system by generating a negative pressure.

In accordance with a further feature of the invention, the ink containers are first and second ink containers, and the threaded spindle forces ink out of the second ink container into the first ink container and delivers the ink to the inking system by generating an overpressure.

In accordance with an added feature of the invention, the ink containers are disposed one inside the other.

In accordance with an additional feature of the invention, the electric motor and the coupling form a drive mechanism disposed completely inside the second ink container.

In accordance with a concomitant feature of the invention, the guide tube and the threaded spindle are flexible.

Other features which are considered as characteristic for the invention are set forth in the appended claims.

Although the invention is illustrated and described herein as embodied in a pump configuration for an ink supply tank of an inking system in franking and value stamping machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

The drawing is a fragmentary, diagrammatic, partly broken-away, exploded perspective view of the configuration according to the invention.

Referring now to the single figure of the drawing in detail, there is seen an illustration of the principle of the pump configuration according to the invention, in the form of a version with an aspirating threaded spindle.

The pump configuration is used for pumping ink from an ink supply tank which includes a first upper ink container 2 and a second lower ink container 5, each of which serves as an ink supply container. The pump configuration and the ink containers 2, 5 together form a pump assembly. The two ink containers 2, 5 are disposed one above the other. The upper ink container 5 also protrudes partway into the lower ink container 2. When used in franking or value stamping machines for a low number of franking operations and where less ink is therefore required, the upper ink container 5 may be fully integrated into the lower ink container 2. The two ink containers 2, 5 communicate with one another through a guide tube 3. A threaded spindle 1 is supported in the guide tube 3. The threaded spindle 1 acts as a pumping unit that is moved by an electric motor 7 through a coupling 6, which may be formed of bevel wheels and spur wheels. The electric motor 7 and the coupling 6 together form electric drive means. The coupling 6 may be structurally disposed inside or outside the upper ink container 5.

The ink containers 2, 5 communicate with an inking system 9 of the franking or value stamping machine through separate tube or hose connections 4, 8. The inking system 9 has a housing 11 in which inking rollers 10 are disposed. In the example shown which has an aspirating threaded spindle 1, the ink is moved by means of the spindle from the lower ink container 2 into the upper container 5 by the generation of a negative pressure. From there, the ink is carried through the tube or hose connection 8 into the inking system 9 through an inflow or inlet neck 12 thereof that is located at a lower level. The return of unneeded ink through an outflow or outlet neck 13 of the inking system 9 that is located at a higher level, is carried out through the hose connection 4 leading back into the lower ink container 2.

This continuous circulation that is used in combination with the threaded spindle 1 as the pumping means prevents thickening of the ink. If an inking system starts up again after a relatively long idle time, the ink regains its original consistency in the briefest possible time, as the result of the threaded spindle 1.

By suitably covering the ink containers 2, 5 and the inking mechanism 9, soiling of the ink is only possibly to a limited extent, which moreover is practically precluded as a consequence of the thorough mixing or recirculation of the ink by the threaded spindle.

Instead of the aspirating threaded spindle 1 shown in the drawing, an overpressure can also be generated, by reversing the direction of rotation. The overpressure carries the ink from the upper ink container 5 into the lower ink container 2. In the inking mechanism 9, only the incoming and outgoing tube or hose connections 8, 4 need to be interchanged.

For the sake of providing a compact structure, on one hand one ink container 5 is placed in the other ink container 2, as already described. On the other hand, the entire drive mechanism, including the coupling 6 and the electric motor 7, may be disposed inside one ink container 5 for this purpose. Placing the complete drive mechanism inside the ink container 5 also avoids leaks.

If the threaded spindle 1 is flexibly constructed, then the guide tube 3 in which it is inserted can likewise be flexible, thereby further optimally utilizing space.

If the pump configuration is controlled as a function of the franking or value stamping imprints, then less wear and less heating of the ink are obtained.

We claim:

1. In a franking and value stamping machine having an inking system with a housing, inking rollers, and inlet and return necks, a pump assembly comprising tube or hose connections communicating with the inlet and return necks, an ink supply tank communicating with said tube or hose connections and having two ink containers, a guide tube through which said ink containers communicate with each other, an electric motor, a coupling connected to said electric motor, and a threaded spindle being supported in said guide tube and driven by said electric motor through said coupling as a pumping unit.

2. The pump assembly according to claim 1, wherein said ink containers are first and second ink containers, and said threaded spindle aspirates ink from said first ink container into said second ink container and delivers the ink to the inking system by generating a negative pressure.

3. The pump assembly according to claim 1, wherein said ink containers are first and second ink containers, and said threaded spindle forces ink out of said second ink container into said first ink container and delivers the ink to the inking system by generating an overpressure.

4. The pump assembly according to claim 1, wherein said ink containers are disposed one inside the other.

5. The pump assembly according to claim 1, wherein said electric motor and said coupling form a drive mechanism disposed completely inside one of said ink containers.

6. The pump assembly according to claim 2, wherein said electric motor and said coupling form a drive mechanism disposed completely inside said second ink container.

7. The pump assembly according to claim 3, wherein said electric motor and said coupling form a drive mechanism disposed completely inside said second ink container.

8. The pump assembly according to claim 1, wherein said guide tube and said threaded spindle are flexible.

9. In a franking and value stamping machine having an inking system, a pump assembly comprising tube or hose connections communicating with the inking system, an ink supply tank communicating with said tube or hose connections and having two ink containers, a guide tube through which said ink containers communicate with each other, electric drive means, and a threaded spindle being supported in said guide tube and driven by said electric drive means as a pumping unit.

* * * * *

UNITED STATES PATENT AND TRADEMARK OFFICE

CERTIFICATE OF CORRECTION

PATENT NO. : 5,193,460
DATED : March 16, 1993
INVENTOR(S) : Lothar Klietz, Ernst Prohaska It is certified that error appears in the above-indentified patent and that said Letters Patent is hereby corrected as shown below:

On the title page, under item [19] and item [75], change "Kleitz" to --Klietz--.

Signed and Sealed this

Fourth Day of January, 1994

*Attest:*

*Attesting Officer*

BRUCE LEHMAN

*Commissioner of Patents and Trademarks*